US005189339A

United States Patent [19]

Peshak

[11] Patent Number: 5,189,339

[45] Date of Patent: Feb. 23, 1993

[54] FLUORESCENT LAMP ASSEMBLIES

[75] Inventor: Gayle R. Peshak, Lake Forest, Ill.

[73] Assignee: Applied Lumens, Ltd., Lake Forest, Ill.

[21] Appl. No.: 577,492

[22] Filed: Sep. 5, 1990

[51] Int. Cl.[5] ..... H01J 7/44

[52] U.S. Cl. ..... 315/58; 315/56; 315/57; 362/216; 362/260

[58] Field of Search ..... 315/56, 57, 58, 62, 315/53; 362/260, 216, 226, 267

[56] References Cited

U.S. PATENT DOCUMENTS 4,520,436 5/1985 McNair et al. ..... 362/216
4,723,200 2/1988 Troen ..... 362/260
4,746,840 5/1988 Lim ..... 315/58
4,763,233 8/1988 Poyer ..... 362/267
4,931,696 6/1990 Brower ..... 315/61
4,961,027 10/1990 Mijessli ..... 315/53

*Primary Examiner*—Eugene R. LaRoche
*Assistant Examiner*—Son Dinh
*Attorney, Agent, or Firm*—Charles A. McClure

[57] ABSTRACT

Fluorescent lamp assemblies with screw-in bases and solid-state ballasts, useful indoors or outdoors, such as in reflector spotlight or floodlight or table lighting. A two-piece non-conductive housing is retained simply by a pair of screws or the like, and laterally surrounds a fluorescent lamp assembly and its ballast, and also has a ratcheting screw-in Edison base on one end and a lens covering the light-emitting opposite end. Families of such lamp assemblies with different wattages and/or different beam-spreads are suitable for such usage, and for use in canister-like ceiling or wall fixtures.

24 Claims, 3 Drawing Sheets

FLUORESCENT LAMP ASSEMBLIES

TECHNICAL FIELD

This invention relates to compact fluorescent lamp assemblies with screw-in bases and solid-state ballasts, adapted to replace incandescent lamps indoors or outdoors, as in reflector floodlight, spotlight, or table lighting.

BACKGROUND OF THE INVENTION

Incandescent lamps convert a miniscule fraction of electrical energy into visible light, whereas fluorescent lamps are many times as efficient energy converters and, thus, are energy savers. Also, as the useful life of a fluorescent lamp is usually much longer than that of an incandescent lamp, replacement labor cost is much lower.

Conventional floodlights and spotlights have incandescent lamps and are quite bright and hot in use, whereas fluorescent lamps run much cooler, are generally less bright, and are more difficult to focus for such usage. Conventional incandescent lamps have no extra space for the ballasts required by fluorescent lamps. Incandescent spotlights and floodlights have Edison-type screw-in bases, wherein fluorescent lamps customarily have bayonet or plug-in base contacts.

One-piece cylindrical fluorescent lamps with screw-in bases are known that lack both a lens and access to the ballast. Their throwaway design is limited to standard incandescent lamp uses. Lim U.S. Pat. No. 4,746,840 shows and describes a fluorescent lamp assembly with removable components but with constraints limiting its utility.

SUMMARY OF THE INVENTION

A primary object of the present invention is to provide a compact fluorescent lamp assembly, useful as a floodlight or spotlight, sealed to exclude dirt, grease, and moisture from its interior.

Another object of this invention is to incorporate a solid-state ballast removably in such a fluorescent lamp assembly.

A further object of the invention is to simplify the housing of such a fluorescent lamp assembly.

Yet another object of this invention is to simplify assembling such a fluorescent lamp assembly and disassembling it as desired to replace a ballast or lamp assembly.

A still further object of the invention is to provide a family of such fluorescent lamp assemblies adapted for use in a standard type of canister-like container often used as a ceiling fixture.

In general, the objects of this invention are accomplished, in a fluorescent lamp assembly exhibiting axial symmetry about its longitudinal axis, by means of a lamp and a solid-state ballast therefor, and laterally surrounding non-conductive housing means having an electrical screw-in base end and a flared open end, which preferably is customarily covered with a removable lens.

More particularly, the objects of the invention are attained, in such a fluorescent lamp assembly, via a reflective housing member laterally surrounding the lamp, having a flared light-emitting end and a smaller opposite end, and an Edison hood having a small end with an electrical screw-in base and a larger opposite end overlapping the smaller end of the reflective housing member, defining an annular space therebetween to accommodate ballast components.

Method aspects of this invention include inserting pin contacts of a fluorescent lamp into contactor openings in a solid-state ballast circuit board during assembly and withdrawing such contacts from such contactor openings in removing the lamp for replacement.

Other objects of the present invention, together with means and methods for attaining the various objects, will be apparent from the following description and accompanying diagrams of preferred embodiments, which are presented by way of example rather than limitation.

DESCRIPTION OF THE INVENTION

Figures 1, 2, 2A:
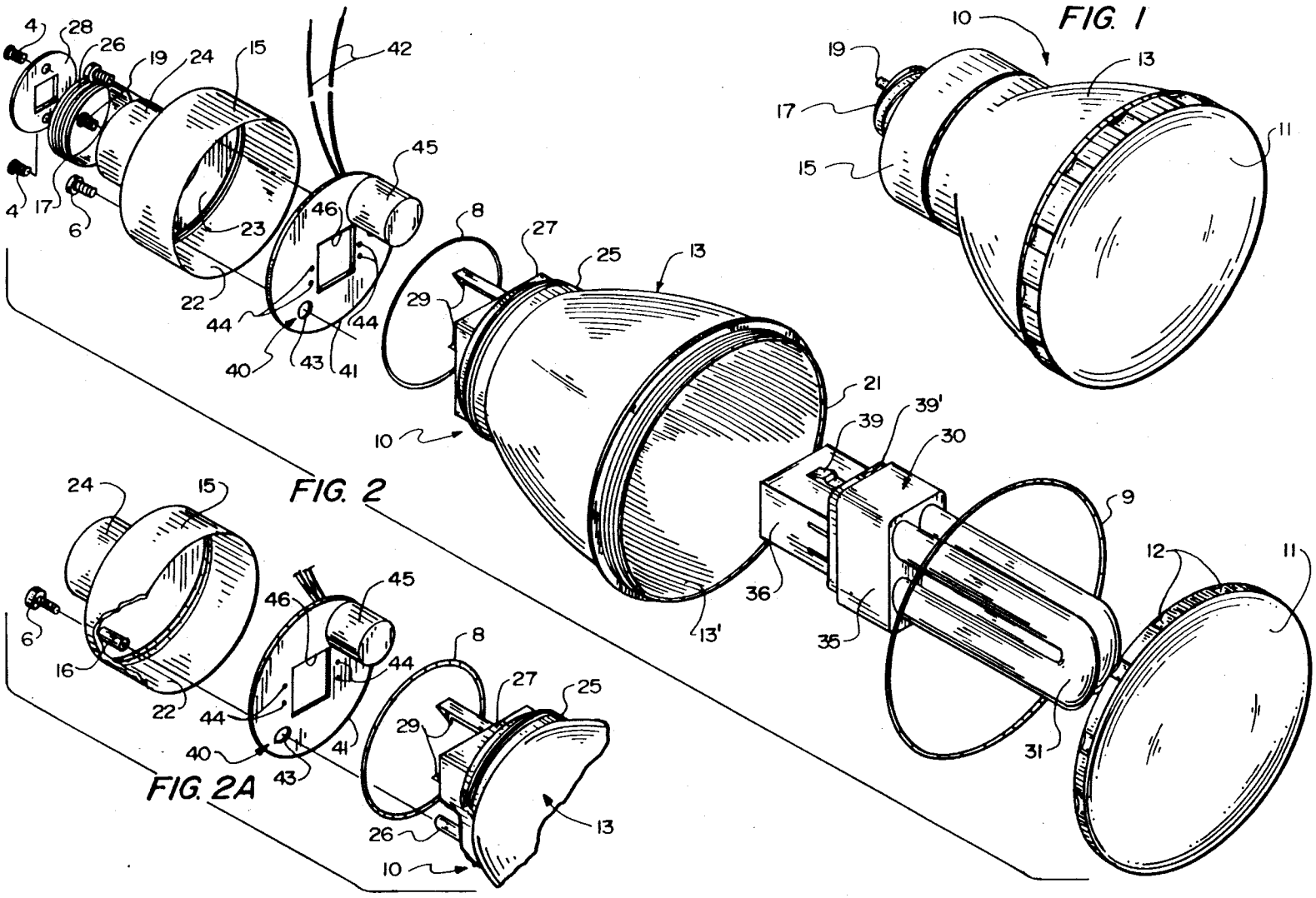
FIG. 1 is a perspective view of a fluorescent lamp according to this invention.
FIG. 2 is an exploded, nearly side-on, perspective view of a first embodiment of fluorescent lamp of this invention.
FIG. 2A is a detail from FIG. 2 partly cut away.

FIGS. 1 and 2 show, in perspective, compact fluorescent lamp 10 of this invention, first fully assembled and then exploded along its longitudinal axis, about which it exhibits substantial symmetry.

Lens 11 threads onto near edge 21 of the outwardly flared large end of reflective housing 13, which accommodates lamp bulb assembly 30. The lens has flutes 12 (concave indentations) spaced at regular intervals about its flanged circumferential edge. O-ring 9 (a seal) intervenes between that externally threaded edge of the reflective housing and the internally threaded flanged far edge of the lens. The flared portion of the reflective housing has reflective layer 13' on its inside wall surface. The reflective housing necks down to shoulder 25 and terminates in even smaller square end portion 27.

Edison hood 15 has larger near cylindrical portion 22, which is adapted to overlap the reflective housing small end 27 and to abut its shoulder 25, with O-ring 8 (a seal) intervening (at the site of slot 14 in FIG. 1). Ballast assembly 40 on circuit board 41 fits between small end 27 of the reflective housing and the larger end of the Edison hood—actually within that larger end. The Edison hood is stepped down to small (far) cylindrical end portion 24, which carries screw-in Edison electrical base 17. Ratchet plate 28 (a protection against overtightening) is retained to the base by rivets 4. Central electrical terminal 19 protrudes beyond both the base and the ratchet plate. Protruding to the interior of larger cylindrical portion 22 of the Edison hood (as lamp base retainers) are pair of flexible prongs 29 secured to small end part 27 of the reflective housing.

FIG. 2A details one aligned screw 6, boss 16 on the inside of stepped wall 23 of Edison hood 15, opening 43 of circuit board 41, and boss 26 on the outside of small end portion 27 of reflective housing 13. A pair of such screws hold the assembly together via a pair of such bosses on each of the two respective housing members.

Figure 3:
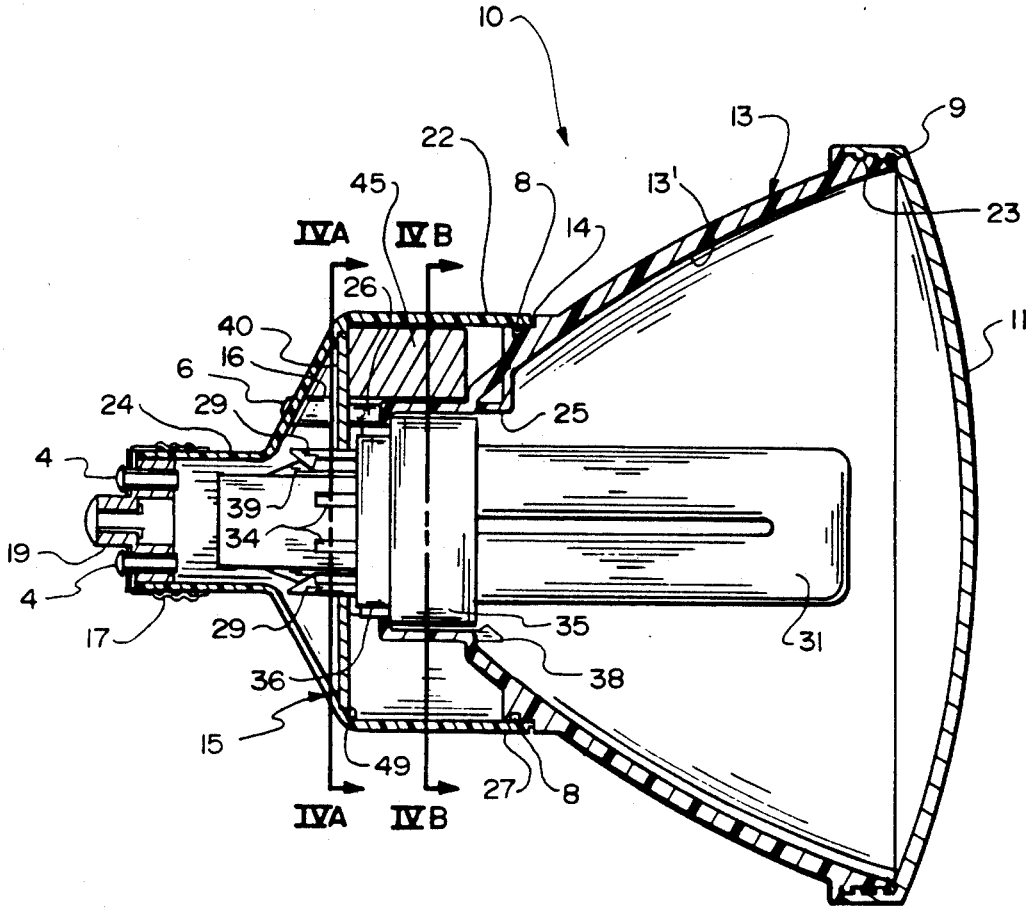
FIG. 3 is an assembled side sectional elevation of the parts shown exploded in the preceding view.

FIG. 3 shows assembled fluorescent lamp 10 in medial sectional elevation, featuring the interfitting of the pieces once assembled. As just noted, pair of screws 6 through bosses 16, circuit board openings 43, and into bosses 26 retain the assembly together. Three small circumferentially spaced intruding grippers 49 (one shown) on the inside of the large cylindrical portion of the Edison hood also aid in holding the circuit board in place. Components on the circuit board include most prominently capacitor 45, but no attempt is made here to show the other electrical components on the board. Pair 42 of electrical leads are shown, and it will be understood that the leads connect to the screw-in base and the central terminal in conventional manner.

FIG. 3 shows lamp assembly 30 as conventional, with four-lobed or "quad" lamp bulb 31 mounted on base 35 from which stem or extension 36 extends. Its light-emitting tubing 31 is located within the reflectively coated surface of the flared portion of reflective housing 13, well spaced from the end plane covered by the lens. Pin contacts 34 extend from the base of the lamp into contactor openings 44 in circuit board 41 of ballast assembly 40. The lamp base is provided with stemlike extension 36, which has pair of lateral bosses 39—which interfit with prongs 29 on the reflective housing to aid in retaining the lamp in place. Flexible retainers 38 (one visible) at the junction of the parabolic wall of the reflector housing to its smaller (square) end aid in retaining the lamp in place.

Figure 4A:
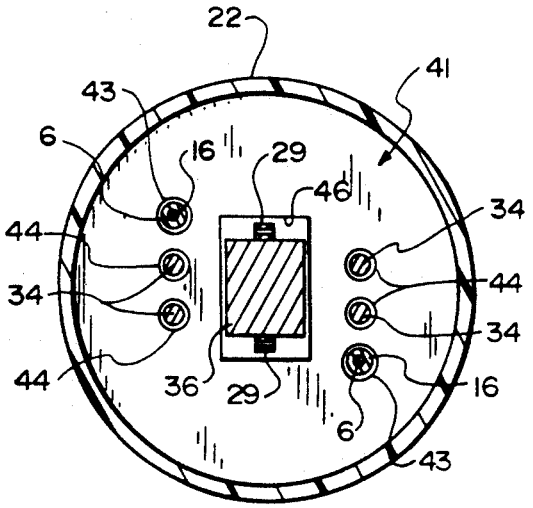
FIGS. 4A and 4B are transverse sectional elevations of the same fluorescent lamp, taken as indicated at IVA and IVB in FIG. 3.
Figure 4B:
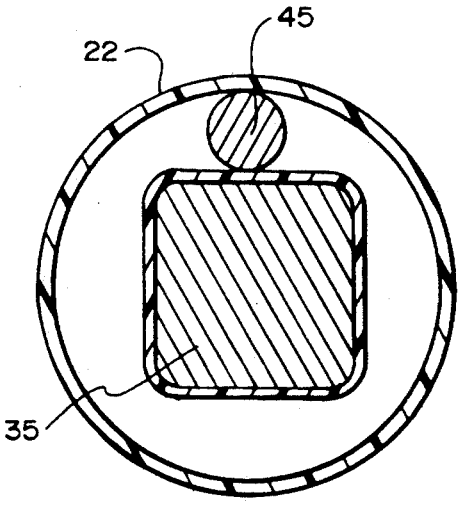

FIGS. 4A and 4B show transverse sections through lamp assembly 10 of this invention, taken on FIG. 3 at IVA and IVB, respectively. The components of a solid-state ballast fit in the annular space between the lamp base and the surrounding Edison hood, and these sectional views are taken in that vicinity. (Not shown in any view is ballast potting material, which may—but need not—be present.)

FIG. 4A shows the bottom face of circuit board 41, which helps to define the annular space just mentioned. The circuit board has central opening 46 surrounding base stem 36 of lamp bulb assembly 30 and pair of sloping bosses 39 thereon. Pair of openings 43 receive retaining screws 6, and four small contactor openings 44 receive pin contacts 34 of the lamp bulb—all surrounded by large end portion 22 of the Edison hood. FIG. 4B shows lamp base 35 surrounded only by larger end 22 of the Edison hood, with capacitor 45 intervening—and other circuit board components not shown.

Figure 5A:
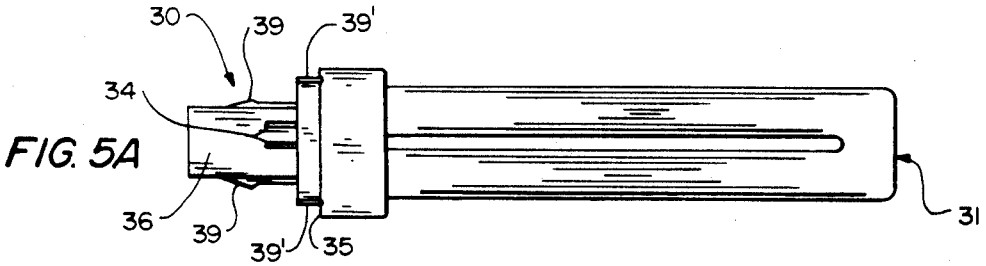
FIG. 5A is a top elevation of a fluorescent lamp apart from other members of the lamp assembly.
Figure 5B:
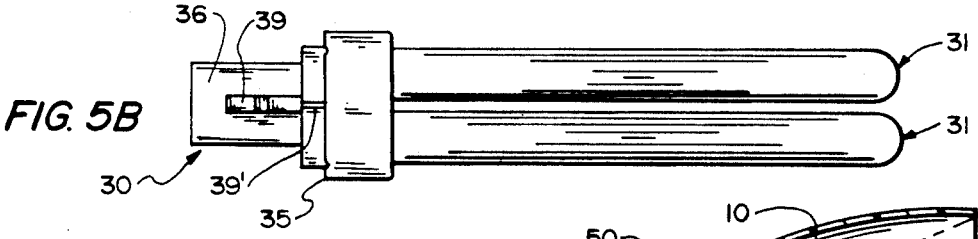
FIG. 5B is a top elevation of the same fluorescent lamp apart from other members of the lamp assembly.
Figure 5C:
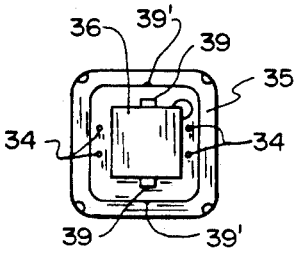
FIG. 5C is a bottom or base plan of the same lamp.

FIGS. 5A, 5B, and 5C show, in top, side, and end elevation, respectively, fluorescent lamp assembly 30 in greater detail. The lamp itself comprises four lobes of a continuous tube, each entering base 35. A total of four pin contacts protrude from the base, two at each side of base extension 36, which carries retainer bosses 39 at opposite sides—to interfit with prongs 29 affixed to the reflective housing as a form of retention means for lamp bulb assembly 30.

Figure 6A:
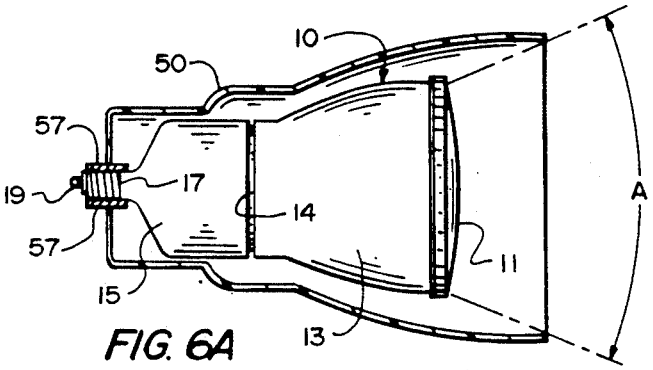
FIGS. 6A, 6B, and 6C are side elevations, sectioned in part, of alternative embodiments of lamp assembly of this invention within an external open-ended canister-like reflective metallic housing.
Figure 6B:
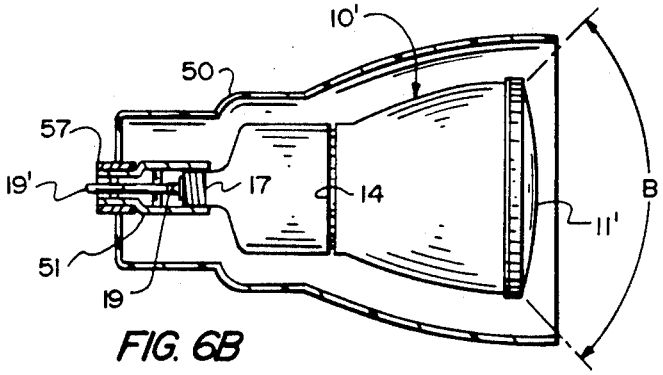
Figure 6C:
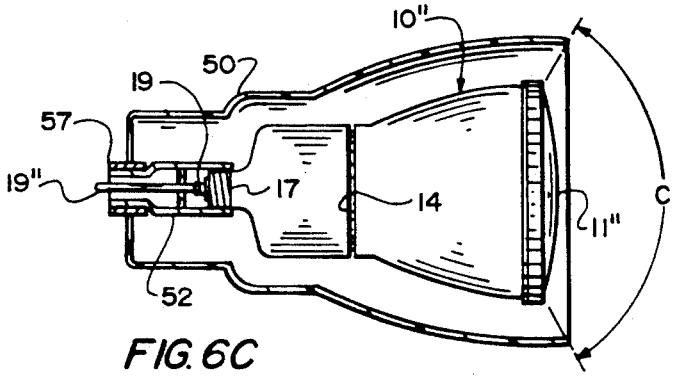

FIGS. 6A, 6B, and 6C show in side elevation, sectioned in part, alternative embodiments of the lamp of this invention featuring a range of beam-spread patterns installed in an external conventional canister-like metal reflective fixture. First lamp/fixture assembly 10 appears in FIG. 6A, wherein the lamp is mounted deep in the fixture (screwed directly into fixture electrical socket 57), with its lens 11 shown providing relatively narrow beam-spread A, such as of about 45° around the axis (as indicated by dashed lines and arrows). FIG. 6B shows alternative embodiment 10' of lamp/fixture assembly according to this invention, with lens 11' having an intermediate beam-spread B, about 90°, mounted nearer the open end of the fixture, by interposition of short screw-in adapter 51 between the base of the assembly and socket 47. FIG. 6C shows further embodiment 10'' of lamp/fixture assembly of this invention, with lens 11' having a wide beam-spread C, such as about 130°, mounted nearer the open end of the fixture, by means of longer screw-in adapter 52 between the base of the assembly and socket 47. It will be understood that, in these lamp/fixture embodiments, the lens need be the only component to undergo change. However, the neck of the Edison hood could be extended appropriately to eliminate the interposed adapter. Moreover, the wattage of the lamp may be altered as well, if desired to alter the light output independently of beam-spread, and other features (such as retainers) may be modified accordingly.

The invention is not dependent upon any particular solid-state ballast design; examples of solid-state ballasts in U.S. patents include Stoltz U.S. Pat. No. 4,251,752; Stevens U.S. Pat. No. 4,277,728; and Knoll U.S. Pat. No. 4,109,307; and references cited. Ordinary skill could adapt one or more of them to this purpose. A suitable ballast is disclosed in a concurrently filed commonly owned R. C. Chatfield patent application. The non-conductive housing and Edison hood can be fabricated by injection molding or other suitable technique from any of a variety of resinous or polymeric materials resistant to fluorescent lamp operating temperatures (e.g., 50° C. plus a safety margin of 50%). Epoxy or other thermosetting resins are suitable, as are silicone resins and polycarbonates, for the housing members. Skilled persons will consider cost as well as durability in choosing such materials. Reflective coatings may be vacuum metalized or be formed otherwise.

In the two-piece housing means of this invention the reflective housing houses mainly the lamp assembly, whereas the Edison hood houses mainly the ballast assembly, whereas the two housings together house both ballast and lamp assembly components. The arrangement may be looked upon as three distinct compartments: one within the interior of the reflective housing, another one within the Edison hood alone, and a third one annularly between the Edison hood and the non-reflective part of the reflective housing. The two end compartments communicate with one another, of course. The lamp is within the first compartment, the base of the lamp bridges the first and second compartments, with the extension of the base more within the second compartment, and the ballast components are within the annular third compartment bounded in part by the circuit board as well as by the reflective housing and the Edison hood, The present invention features ready interchangeability and/or replacement of its components. Lenses may be changed as indicated. The two-piece housing means of this invention, with only a pair of securing screws, can be assembled and disassembled more readily and simply than previous fluorescent lamp containers. This enables economical replacement of ballast and/or lamp, such as to change the wattage for a different use or simply for maintenance replacement.

Fluorescent lamps so useful are staple articles of commerce, available from such noted firms as General Electric, North American Philips, Osram, or Sylvania. Lamp bulbs from any source may fail from abnormal or lengthy normal use. Here one may be changed merely by unscrewing the lens, pulling out the old lamp bulb, inserting a new one, and screwing the lens back on. Ballasts may be changed by detaching the Edison hood from the reflective housing, removing the ballast assembly with circuit board from the Edison hood, disconnecting its electrical leads, inserting a new circuit board, connecting its leads in place of the ones just disconnected, and reattaching the Edison hood. Alternatively, the Edison hood with ballast may be discarded entirely, and a new hood and ballast be substituted.

Other modifications may be made, as by adding, combining, deleting, or subdividing compositions, parts, or steps, while retaining at least some of the advantages and benefits of the present invention—which itself is defined in the following claims.

I claim:

1. Fluorescent lamp assembly with axial symmetry, comprising a fluorescent lamp bulb and a solid-state ballast therefor, and two-member laterally bulb-surrounding and ballast-surrounding non-conductive housing means including a first one-piece housing member with a large flared open end to be sealed by a covering lens and with a small open end adapted to surround part of the lamp bulb, and a second one-piece housing member with a small open end to be covered by electrical screw-in means and with a large open end adapted to surround the ballast and overlap the small end of and be sealed to the first member.

2. Fluorescent lamp assembly according to claim 1, including a reflective coating on the inside surface of the first member of the laterally surrounding nonconductive housing means in the vicinity of the lamp bulb.

3. Fluorescent lamp assembly comprising lamp bulb and ballast and first and second open-ended non-conductive housing members, each housing member having a large end and a small end, the large end of the second housing member overlapping the small end of the first housing member, wherein the ballast comprises a circuit board juxtaposed transversely against the small end of the first housing member, defining therewith and with the overlapping larger end of the second housing member an annular compartment, such annular compartment being adapted to accommodate ballast components mounted on the circuit board.

4. Fluorescent lamp assembly according to claim 3, wherein the lamp bulb has a base with protruding electrical plug-in contacts, and the circuit board has contactor openings accommodating such contacts.

5. Fluorescent lamp assembly according to claim 3, wherein the lamp bulb has a base with an extension of reduced transverse section extending therefrom, and the circuit board has a central opening therein smaller than the small end of the first housing member but adapted to accommodate the extension of the lamp base.

6. Sealed fluorescent lamp assembly with longitudinal axial symmetry, comprising a fluorescent lamp bulb and a solid-state ballast therefor, plus a reflective housing member laterally surrounding the bulb and having a flared light-emitting end with covering lens and a smaller opposite end, and an Edison hood having a small end with an electrical screw-in base and a larger opposite end overlapping and be sealed to the smaller end of the reflective housing member, defining an annular space therebetween adapted to accommodate solid-state ballast components therewithin.

7. Sealed fluorescent lamp assembly according to claim 6, including a circuit board transverse to the axis within the larger end of the Edison hood and juxtaposed to the smaller end of the reflective housing and thereby adapted to define further such annular space, with ballast components mounted thereon extending into such space, with such larger end of the Edison hood so surrounding such ballast components, and surrounding in turn at least part of the smaller end of the reflective housing.

8. Sealed fluorescent lamp assembly according to claim 7, wherein the circuit board has a coaxial opening smaller than the smaller end of the reflective housing and is thereby adapted to surround a base part of the lamp bulb when such bulb is in place in such housing.

9. Method of assembling the sealed fluorescent lamp assembly of claim 8, wherein the lamp bulb has base pin contacts, and wherein the circuit board has contactor openings adapted to receive such contacts, comprising the steps of inserting such circuit board with ballast components thereon into the large end of the Edison hood and securing them together, overlapping the larger end of the Edison hood about the smaller end of the reflective housing and securing and sealing them removably together, inserting the lamp bulb into the flared end of the reflective housing and inserting its base pin contacts into the contactor openings in the circuit board, and securing and sealing the lens over the large end of the reflective housing.

10. Method of replacing the ballast of a sealed fluorescent lamp assembly assembled according to claim 9, comprising unsealing and separating the Edison hood with ballast from the reflective housing, removing the ballast from the Edison hood, discarding the ballast, inserting a new ballast into the Edison hood, and securing and resealing the Edison hood with new ballast therein removably to the reflective housing.

11. Method of replacing the ballast of a sealed fluorescent lamp assembly assembled according to claim 9, comprising unsealing and separating the Edison hood with ballast from the reflective housing, inserting a new ballast into a new Edison hood, and securing and resealing the new Edison hood with new ballast therein removably to the reflective housing.

12. Method of replacing the lamp bulb of a sealed fluorescent lamp assembly assembled according to claim 9, comprising removing the lens covering the light-emitting end of the reflective housing unplugging the pin contacts of the lamp bulb from the circuit board and removing the lamp bulb from the reflective housing, and then inserting a new lamp bulb into the housing and its pin contacts into the contactor openings and recovering and resealing the housing with the lens.

13. Fluorescent lamp assembly assembled and sealed according to claim 9.

14. Sealed fluorescent lamp assembly according to claim 13, in combination with a canister-like ceiling fixture having a closed end enclosing an interior socket to accommodate the screw-in connector of such fluorescent lamp assembly and having an open light-emitting end, the lens having a characteristic beam-dispersing angle matched to the depth of insertion of the lamp bulb.

15. Two-piece housing for a fluorescent lamp assembly with axial symmetry, comprising a first housing member with a flared large open end adapted to emit light when a lamp is therein and with a smaller open end, and a second housing member with a small end adapted to carry a screw-in electrical fitting and with a larger open end overlapping and juxtaposed to the first housing member about the smaller open end thereof, the overlapping ends of the respective housing members being non-conductive and defining therebetween an annular space adapted to receive a solid-state ballast therewithin.

16. Two-piece housing according to claim 15, wherein both of the housing members are non-conductive throughout their overlapping extent.

17. Two-piece housing according to claim 15, wherein both of the housing members are adapted to be secured together when so juxtaposed, by retaining means accessible at the exterior of the small end of the second housing means, plus such retaining means.

18. Two-piece housing according to claim 15, wherein both of the housing members are further adapted to be sealed disengageably together when so juxtaposed, plus sealing means adapted to do so.

19. Two-piece housing according to claim 17, wherein the large open end of the first housing member is adapted to be covered by a lens, and wherein the first housing member and the lens are adapted to be sealed disengageably together, plus sealing means adapted to do so.

20. Article of manufacture comprising a two-piece housing for a fluorescent lamp assembly according to claim 15 provided with a solid-state ballast of annular form adapted to be received within the annular space between the overlapping non-conductive housing ends and itself being adapted to receive within its annular space the base of a fluorescent lamp bulb extending thereinto from the first housing member when in place therewithin.

21. Two-piece fluorescent lamp assembly according to claim 20, plus such solid-state ballast within the annular space between the overlapping non-conductive housing ends, itself adapted to receive within its annular space the base of a fluorescent lamp bulb extending thereinto from the first housing member when in place therein.

22. Two-piece fluorescent lamp assembly according to claim 21, plus a fluorescent lamp bulb with base extending within the annular space of the solid-state ballast.

23. Two-piece fluorescent lamp assembly according to claim 22, wherein the ballast has openings therein to receive electrical contactors and the lamp bulb has electrical contactors extending from its base and fitting in such openings.

24. Two-piece fluorescent lamp assembly according to claim 23, in combination with a canister type of fixture having a closed end enclosing an interior socket for the screw-in connector of the lamp assembly, having an open light-emitting end, and being cylindrical and large enough intermediately to receive the lamp assembly therewithin spaced from the fixture.

* * * * *